US006817100B2

(12) United States Patent
Mori et al.

(10) Patent No.: US 6,817,100 B2
(45) Date of Patent: Nov. 16, 2004

(54) STEERING WHEEL AND METHOD FOR MANUFACTURING STEERING WHEEL

(75) Inventors: Hiroki Mori, Niwa-gun (JP); Hisao Yamada, Niwa-gun (JP); Yuji Tajiri, Niwa-gun (JP); Keizo Suzuki, Niwa-gun (JP)

(73) Assignee: Kabushiki Kaisha Tokai-Rika Denki Seisakusho, Aichi-ken (JP)

( * ) Notice: Subject to any disclaimer, the term of this patent is extended or adjusted under 35 U.S.C. 154(b) by 0 days.

(21) Appl. No.: 09/983,358

(22) Filed: Oct. 24, 2001

(65) Prior Publication Data

US 2002/0046620 A1 Apr. 25, 2002

(30) Foreign Application Priority Data

Oct. 25, 2000 (JP) ..... 2000-325848

(51) Int. Cl.[7] ..... B21D 53/26
(52) U.S. Cl. ..... 29/894.1
(58) Field of Search ..... 29/894.1; 74/552

(56) References Cited

U.S. PATENT DOCUMENTS 4,959,902 A * 10/1990 Hamilton

FOREIGN PATENT DOCUMENTS

JP 11-034881 2/1999

* cited by examiner

*Primary Examiner*—Irene Cuda Rosenbaum
(74) *Attorney, Agent, or Firm*—Nixon Peabody, LLP

(57) ABSTRACT

A steering wheel having partially applied wooden outer covers, which can be produced without having the wooden outer covers scratched, and the like, and can be produced with high working efficiency, and a method for manufacturing the steering wheel are provided. Raw materials, from which wood members are formed, are attached at a rim portion of a core metal, and cores are formed in this state. Thereafter, the wood members are shaped from the raw materials. Further, resin pieces are attached in spaces between the wood members and the cores to limit displacement of the wood members. Then, the cores and the resin pieces are covered with covering portions. As described above, spaces are formed, and the cores are formed in a state in which the raw materials of the wood members are attached. This allows shaping of the wood members after formation of the cores. Since the wood members can be shaped after the cores are formed, even if the wood members are scratched while the cores are formed, the scratches can be removed when the wood members are shaped.

3 Claims, 7 Drawing Sheets

STEERING WHEEL AND METHOD FOR MANUFACTURING STEERING WHEEL

BACKGROUND OF THE INVENTION

1. Field of the Invention

The present invention relates to a steering wheel in which a portion of a core metal is covered with a wooden part, and to a method for manufacturing the same.

2. Description of the Related Art

A steering wheel used in a steering device of a vehicle, or the like, is provided with a core metal (a core grid) made of a metal having a ring-shaped rim portion, a boss portion formed at a central portion of the rim portion, and spoke portions for connecting the rim portion and the boss portion integrally. Further, outer coverings are usually attached at a portion of the rim portion and a portion of each spoke portion of the core metal for improving the touch when a driver holds the steering wheel. Some steering wheels employ woods for the outer coverings in order to meet various demands from users, such as matching the steering wheel with interior decoration of the vehicle.

Usually, when woods (wooden outer covers) are partly employed as the outer coverings, and the remaining portions, in which the wooden outer covers are not attached, are covered with synthetic resins such as urethane, the core metal is put in a metal mold for injection molding in a state in which the wooden outer covers, which have been shaped, painted, and the like, are attached at the rim portion. In this state, urethane resin is injected into the metal mold to cover the remaining portions in which the wooden outer covers are not attached with the urethane resin.

However, if the injection molding of the urethane resin is carried out in this manner, surfaces of the wooden outer covers are likely to contact and be scratched by the metal mold when the core metal is put in the metal mold. Therefore, in this case, workers have to pay close attention so as not to contact the wooden outer covers with the metal mold, and this makes the work inefficient.

SUMMARY OF THE INVENTION

In view of the aforementioned, objects of the present invention are to provide a steering wheel having partially applied wooden outer covers, which can be produced without having the wooden outer covers scratched, and the like, and can be produced with high working efficiency, as well as to provide a method for manufacturing the same.

A first aspect of the present invention is a method for manufacturing a steering wheel comprising steps of: attaching a wood member formed from a pure wooden material at a portion of a core metal which is formed in a ring shape; forming an outer covering core material from a synthetic resin material around a predetermined site of the core metal other than a portion at which the wood member is attached; shaping the wood member attached to the core metal after the outer covering core material is formed at the predetermined site.

A second aspect of the present invention is a method for manufacturing a steering wheel according to the first aspect further comprising a step of attaching a limiting member to the core metal at a portion between the wood material and the outer covering core material for limiting relative displacement of the wood member with respect to the outer covering core material along a circumferential direction of the core metal.

In the above-described method for manufacturing a steering wheel, first, the wood members formed from a pure wooden material of wood are attached at portions of the core metal which is formed in a ring shape in a step for attaching wood members. Then, in a step for forming core materials, the outer covering core materials are formed from synthetic resin material around predetermined sites of the core metal other than the portions thereof, at which the wood members are attached.

Further, after the step of forming the core materials, outline of the wood members are shaped in a step of shaping. Note that, since the wood members are shaped after the outer covering core materials are formed in this manufacturing method, even if the outer surfaces of the wood members are scratched when the outer covering core materials are formed, quality of appearance of the wood members in finished state is not degraded.

Moreover, in the second aspect, in a step of attaching the limiting members, the limiting members are attached to the core metal at portions thereof between the outer covering core materials and the shaped wood members, and the limiting members limit relative displacement of the wood members with respect to the outer covering core materials along the circumferential direction of the core metal. That is, since the wood members are shaped after the outer covering core materials are formed in this manufacturing method as described above, minimum spaces are required between the wood members and the outer covering core materials upon shaping the wood members. In this manufacturing method, the limiting members are attached to fill the spaces after the wood members are shaped, and therefore, appearance (of the steering wheel) is not degraded and, at the same time, displacement of the wood members can be limited.

A third aspect of the present invention is a method for manufacturing a steering wheel according to the second aspect further comprising a step of attaching a covering member for covering the outer covering core material and the limiting member from outside to the outer covering core material and the limiting member attached to the core metal.

In the above-described method for manufacturing a steering wheel, the covering portions are attached to both of the outer covering core materials and the limiting members so as to cover the outer covering core materials and the limiting members in the step of attaching covering portions. Thus, the outer covering core materials and the limiting members appear as if they are continuous (integral), and the limiting members are not seen from outside, thereby improving appearance (of the steering wheel).

A fourth aspect of the present invention is a steering wheel comprising: a core metal formed in a substantial ring shape; an outer covering core material for covering a portion of the core metal; a wood member formed from a pure wooden material, for covering the core metal at a side of the outer covering core material along a circumferential direction of the core metal; and a limiting member, which is placed between the outer covering core material and the wood member, for limiting relative displacement of the wood member with respect to the outer covering core material along the circumferential direction of the core metal.

In the steering wheel having the above-described structure, the limiting members are attached between the wood members and the outer covering core materials attached to the core metal, and the limiting members limit relative displacement of the wood members with respect to the outer covering core materials. A width, in the circumferential direction of the core metal, of the limiting member is determined on the basis of a space between the outer covering core material and the wood member which is needed in the shaping of the wood member. (Preferably, the width is the same as the space) That is, in a state before the limiting members are attached to the core metal, there are enough spaces for allowing displacement of the wood members with respect to the outer covering core materials. Presence of these spaces allows shaping, and the like, of the wood members after attachment (forming) of the outer covering core materials. Therefore, even if the outer surfaces of the wood members are scratched when the outer covering core materials are formed, and the like, since the wood member are shaped thereafter, quality of appearance of the steering wheel in a finished state is not degraded.

A fifth aspect of the present invention is the steering wheel according to the fourth aspect further comprising a covering member for covering the outer covering core material and the limiting member from outside.

In the steering wheel having the above-described structure, the limiting members and the outer covering core materials are covered with the covering members. Thus, the outer covering core materials and the limiting members appear as if they are continuous (integral), and the limiting members are not seen from outside, thereby improving appearance (of the steering wheel).

A sixth aspect of the present invention is the steering wheel according to the fourth aspect, wherein a cross section in an axial direction of the core metal of the limiting member is smaller than a cross section in the axial direction of the core metal of the wooden member.

A seventh aspect of the present invention is the steering wheel according to the fourth aspect, wherein the limiting member comprises an occupant side member and a counter occupant side member.

An eighth aspect of the present invention is the steering wheel according to the fourth aspect, wherein the limiting member is made of a single piece.

In the sixth aspect of the present invention, the cross section, in the axial direction of the core metal, of the limiting member is smaller than the cross section, in the axial direction of the core metal, of the wooden member. In the seventh aspect of the present invention, the limiting member comprises the occupant side member and the counter occupant side member.

To be more concrete, an occupant side surface of the occupant side member of the limiting member in the axial direction of the core metal is formed to be positioned at a counter-occupant side, along the axial direction of the core metal, from an occupant side surface of the wood member in the axial direction of the core metal. Further, a counter occupant side surface of the counter occupant side member of the limiting member in the axial direction of the core metal is formed to be positioned at an occupant side, along the axial direction of the core metal, from a counter occupant side surface of the wood member in the axial direction of the core metal.

Therefore, forming the covering member on the limiting member and the outer covering core material becomes easy, and by forming the covering member on the limiting member and the outer covering core material, the limiting member and the outer covering core material cannot be seen from outside. Therefore, appearance (of the steering wheel) is improved.

In the eighth aspect of the present invention, because the limiting member is made of a single piece, reduction of a number of parts can be archived.

DESCRIPTION OF THE PREFERRED EMBODIMENTS

Figure 1:
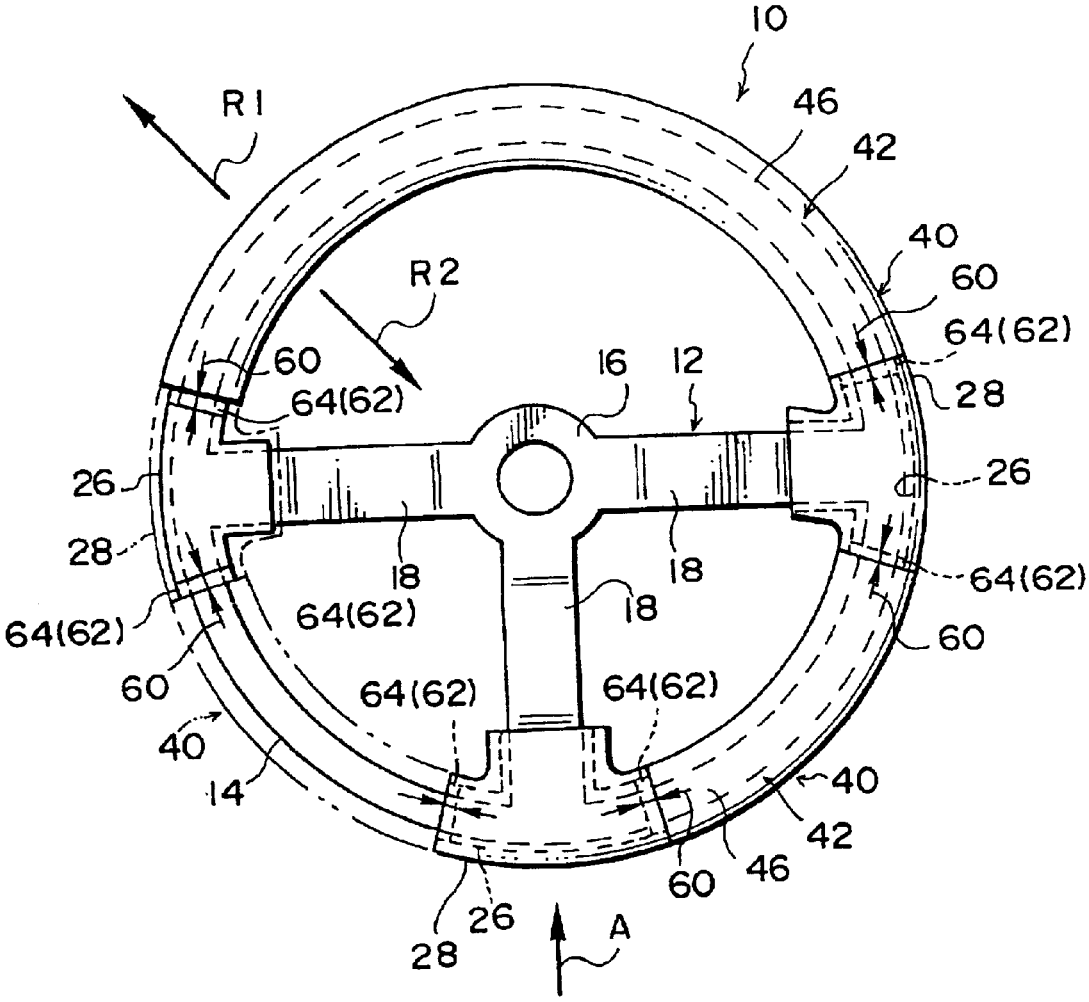
FIG. 1 is a plan view of a steering wheel according to an embodiment of the present invention.
Figure 2:
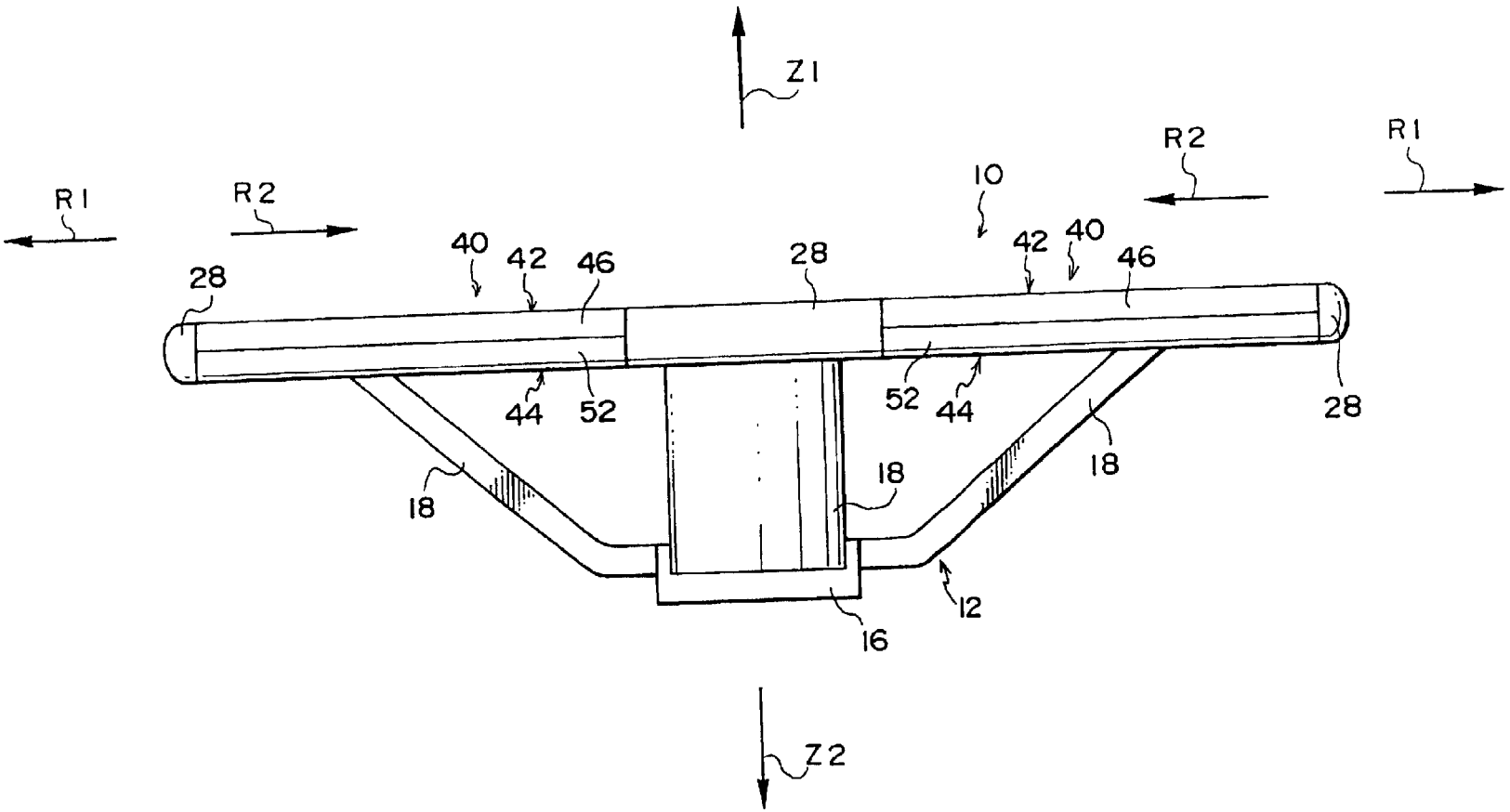
FIG. 2 is an elevational view of the steering wheel according to the embodiment of the present invention.

FIG. 1 is a plan view showing a structure of a steering wheel 10 according to an embodiment of the present invention. FIG. 2 is an elevational view of the steering wheel 10 viewed in a direction of arrow A in FIG. 1. Note that, in each figure, arrow R1 designates an outward direction in a radial direction of a rim portion 14 (described later), and arrow R2 designates an inward direction in the radial direction of the rim portion 14. Further, arrow Z1 designates a direction toward an occupant in an axial direction of the rim portion 14 and arrow Z2 designates a direction away from the occupant in the axial direction of the rim portion 14 in a state in which the steering wheel 10 is mounted in a vehicle.

Figure 3:
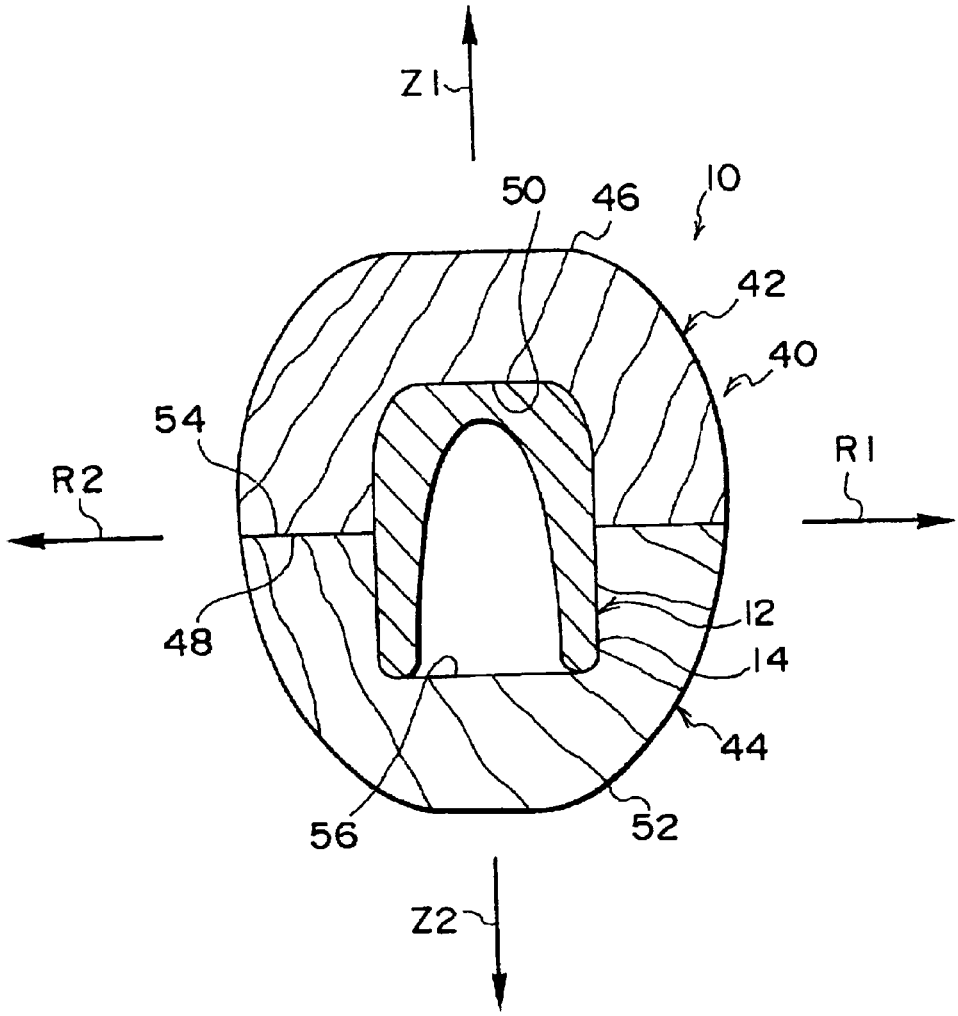
FIG. 3 is a sectional view of the steering wheel at a portion thereof at which a wood member is attached.
Figure 4:
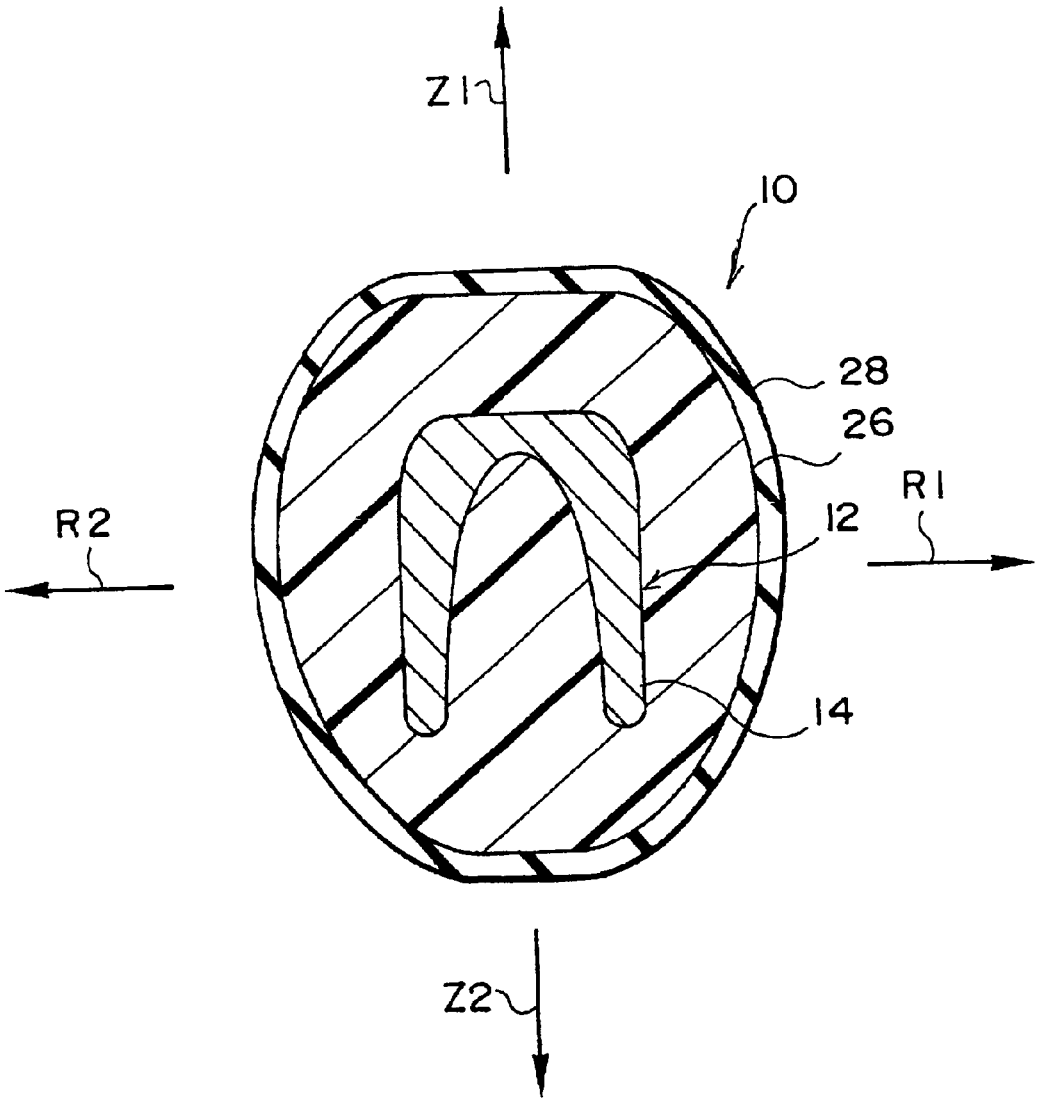
FIG. 4 is a sectional view of the steering wheel at a portion thereof at which a core material is attached.
Figure 5:
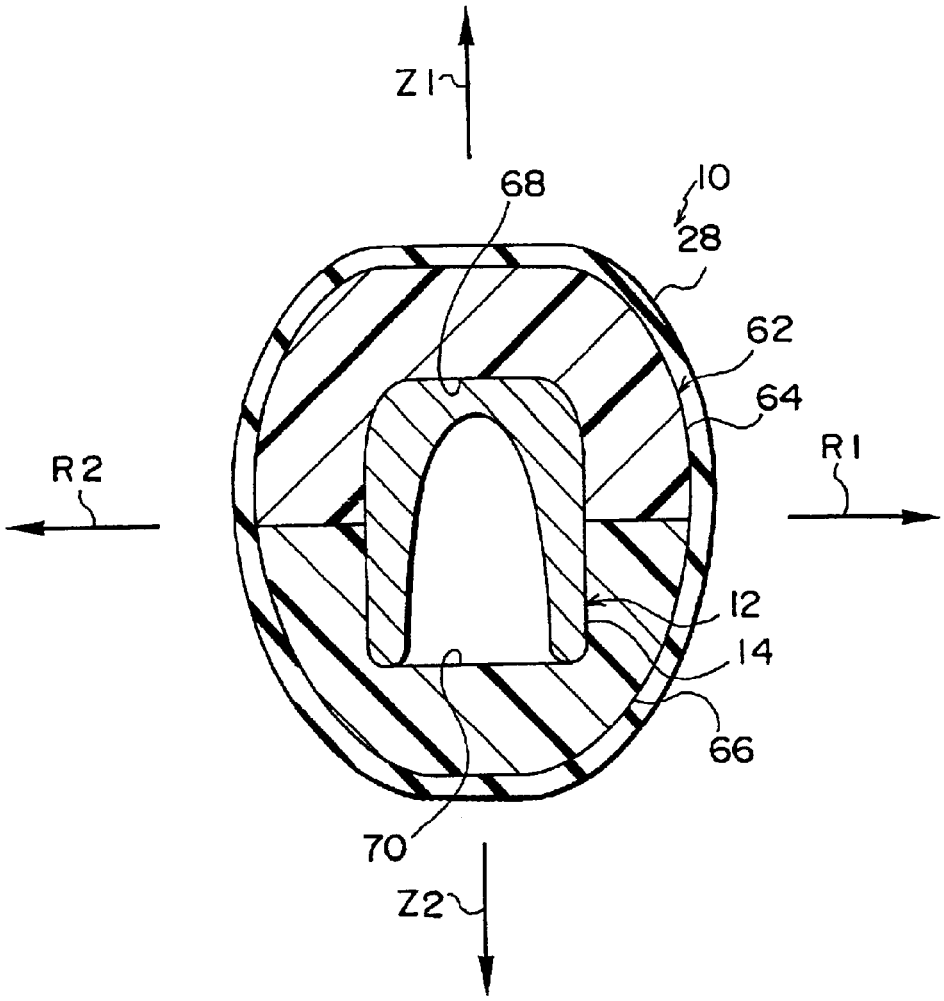
FIG. 5 is a sectional view of the steering wheel at a portion thereof at which a limiting member is attached.

As shown in FIG. 1, the steering wheel 10 is provided with a core metal 12 which is entirely formed, for example, by molding a metal such as magnesium. The core metal 12 is provided with the rim portion 14. The rim portion 14 as a whole has a ring shape, and, as shown in FIGS. 3 to 5, has a concave (an inverted U) sectional form taken along the axial direction thereof, which is open toward a side opposite from the occupant in the axial direction (in the direction of arrow Z2 in FIGS. 3 to 5) in a state it is mounted in the vehicle.

As shown in FIGS. 1 and 2, a boss portion 16 is provided at a center of the rim portion and at the side opposite from the occupant in the axial direction thereof. The boss portion 16 has a substantially thick wall cylindrical shape, and into which a steering shaft forming a steering device of the vehicle (those without a reference numeral are not shown in figures) can fit.

Further, as shown in FIG. 1, three spoke portions 18 are provided between the boss portion 16 and the rim portion 14. As shown in FIG. 2, each of the spoke portions 18 is formed in a plate shape whose longitudinal direction is along the radial direction of the rim portion 14 and whose middle portion in the longitudinal direction is suitably bent like a crank or curved. One end in the longitudinal direction of the each spoke portion 18 is integrally coupled to the rim portion 14, and the other end in the longitudinal direction of the each spoke portion 18 is integrally coupled to the boss portion 16. Thus, the boss portion 16 and the rim portion 14 are integrally coupled through the spoke portions 18. When the rim portion 14 is rotated about its axis, the steering shaft fitted in the boss portion 16 is rotated about its axis, whereby the steering device is operated. Note that, although the number of the spoke portions 18 is three in the present embodiment, there may be at least one spoke portion 18, from a viewpoint of coupling the rim portion 14 and the boss portion 16 together.

Furthermore, as shown in FIG. 1, cores 26, which serve as core materials for outer covers, are attached to the core metal 12. As shown in FIG. 1, the cores 26 are respectively provided at outer cover attachment sites which are portions of the respective spoke portions 18 at the rim portion 14 side, as well as portions of the rim portion 14 in the vicinity of the respective spoke portions 18. The cores 26 are formed, for example, from a urethane type synthetic resin, and cover the portions of the rim portion 14 and the spoke portions 18 corresponding to the outer cover attachment sites from outside. In addition, covering portions 28, which are made of leather, a synthetic resin material, or the like, are formed around the cores 26 so as to cover the portions of the rim portion 14 and the spoke portions 18 corresponding to the outer cover attachment sites as well as the cores 26 from outside.

On the other hand, as shown in FIG. 1, areas corresponding to portions of the rim portion 14 at which the above-described core portions 26 are not attached are wood member attachment sites, at which wood members 40 are attached. As shown in FIG. 3, each of the wood members 40 includes a front-side piece 42 and a back-side piece 44 facing each other along the axial direction of the rim portion 14.

As shown in FIG. 1, the front-side piece 42 is carved from a pure wooden material (a wooden material to which, after natural wood is cut and processed to be a predetermined shape, special processing (for example, laminating and the like) is not administered) of a natural wood into a shape of a curved stick which is arcuate along inner and outer peripheries of the rim portion 14. As shown in FIG. 3, an occupant-side surface 46 of the front-side piece 42 is formed as an arcuate convex surface which projects toward the occupant (in the direction of arrow Z1 in FIG. 3). On the other hand, a joint surface 48 of the front-side piece 42, which is at a side opposite from the occupant-side surface 46, is formed as a plane facing away from the occupant (in the direction of arrow Z2 in FIG. 3). A rim-accommodating groove 50, which is open toward the side opposite from the occupant, is uniformly formed in a central portion in a width direction of the joint surface 48 along a longitudinal direction of the front-side piece 42 (i.e., a peripheral direction of the rim portion 14).

The back-side piece 44 is carved from the pure wooden material of the natural wood, which is the same as that used for carving the front-side piece 42, into a shape of a curved stick which is arcuate along inner and outer peripheries of the rim portion 14. As shown in FIG. 3, a counter-occupant-side surface 52 of the back-side piece 44 is formed as an arcuate convex surface which projects in the direction away from the occupant (in the direction of arrow Z2 in FIG. 3). On the other hand, a joint surface 54 of the back-side piece 44, which is at a side opposite from the counter-occupant-side surface 52, is formed as a plane facing toward the occupant (in the direction of arrow Z1 in FIG. 3). The front-side piece 42 and the back-side piece 44 are joined together by a fixing means such as an adhesive in a state in which the joint surface 54 of the back-side piece 44 and the joint surface 48 of the front-side piece 42 face and contact each other along the axial direction of the rim portion 14.

Further, a rim-accommodating groove 56, which is open toward the occupant, is uniformly formed in a central portion in a width direction of the joint surface 54 along a longitudinal direction of the back-side piece 44 (i.e., a peripheral direction of the rim portion 14). An opening edge of the rim-accommodating groove 50 and an opening edge of the rim-accommodating groove 56 are substantially conform to each other in a state in which the front-side piece 42 and the back-side piece 44 are joined. Therefore, the wood member 40 as a whole is hollow, and accommodates the rim portion 14 therein (i.e., in the rim-accommodating grooves 50 and 56), as shown in FIG. 3. The rim portion 14 fits in inner peripheral portions of the rim-accommodating grooves 50 and 56, or alternatively, is fixed in the rim-accommodating grooves 50 and 56 by a filler or the like (not shown) provided in the rim-accommodating grooves 50 and 56.

Moreover, as shown in FIG. 1, in the steering wheel 10 of the present embodiment, gaps 60 are formed between the cores 26 and the wood members 40, and resin pieces 62 are attached to the rim portion 14 at the gaps 60. As shown in FIG. 5, each of the resin pieces 62 includes a front-side piece 64, which is positioned at the occupant side in the axial direction of the rim portion 14 (at a side in the direction of arrow Z1 in FIG. 5), and a back-side piece 66, which is positioned at a side of the front-side piece 64 opposite from the occupant (at a side in the direction of arrow Z2 in FIG. 5).

As shown in FIG. 5, the front-side piece 64 is molded, for example, from urethane resin or other synthetic resin, and has a concave sectional form which is open toward the side opposite from the occupant. An occupant-side surface of the front-side piece 64 is formed to be positioned at a counter-occupant side along the axial direction of the rim portion 14 from the occupant-side surface 46 of the front-side piece 42 of the wood member 40. Namely, the area of a cross section [in the axial direction] of the core metal of the front-side piece 64 is smaller than the area of a cross section [in the axial direction] of the front-side piece 42 of the wood member 40. While, a counter-occupant-side surface of the front-side piece 64 is a plane, in which a rim-accommodating groove 68 is formed, similarly to the rim-accommodating groove 50 which is formed in the front-side piece 42 of the wood member 40.

The back-side piece 66 is molded, for example, from urethane resin or other synthetic resin, and has a concave sectional form which is open toward the occupant. A counter-occupant-side surface of the back-side piece 66 is formed to be positioned at an occupant side along the axial direction of the rim portion 14 from the counter-occupant-side surface 52 of the back-side piece 44 of the wood member 40. Namely, a cross section in the axial direction of the core metal of the back-side piece 66 is smaller than a cross section in the axial direction of the back-side piece 44 of the wood member 40. While, an occupant-side surface of the back-side piece 66 is a plane, in which a rim-accommodating groove 70 is formed similarly to the rim-accommodating groove 56 which is formed in the back-side piece 44 forming the wood member 40. The front-side piece 64 and the back-side piece 66 are assembled to the rim portion 14 in a state in which opening directions of the rim-accommodating grooves 68 and 70 face each other and the rim-accommodating grooves 68 and 70 accommodate the rim portion 14. The resin piece 62, comprising the front-side piece 64 and the back-side piece 66, limits displacement of the wood member 40 relative to the core 26 along the circumferential direction of the rim portion 14 in such a manner that one end surface of the resin piece 62 in the circumferential direction of the rim portion 14 abuts on the wood member 40, and the other end surface of the resin piece 62 abuts on the core 26.

Further, as shown in FIG. 1, the resin pieces 62 are covered by the covering portions 28, which also cover the cores 26, from outside. Therefore, the cores 26 and the resin pieces 62 as well as boundaries between them cannot be seen from outside.

Next, operation and effects of the present embodiment is described on the basis of a description of a method for manufacturing the present steering wheel 10.

Figure 6:
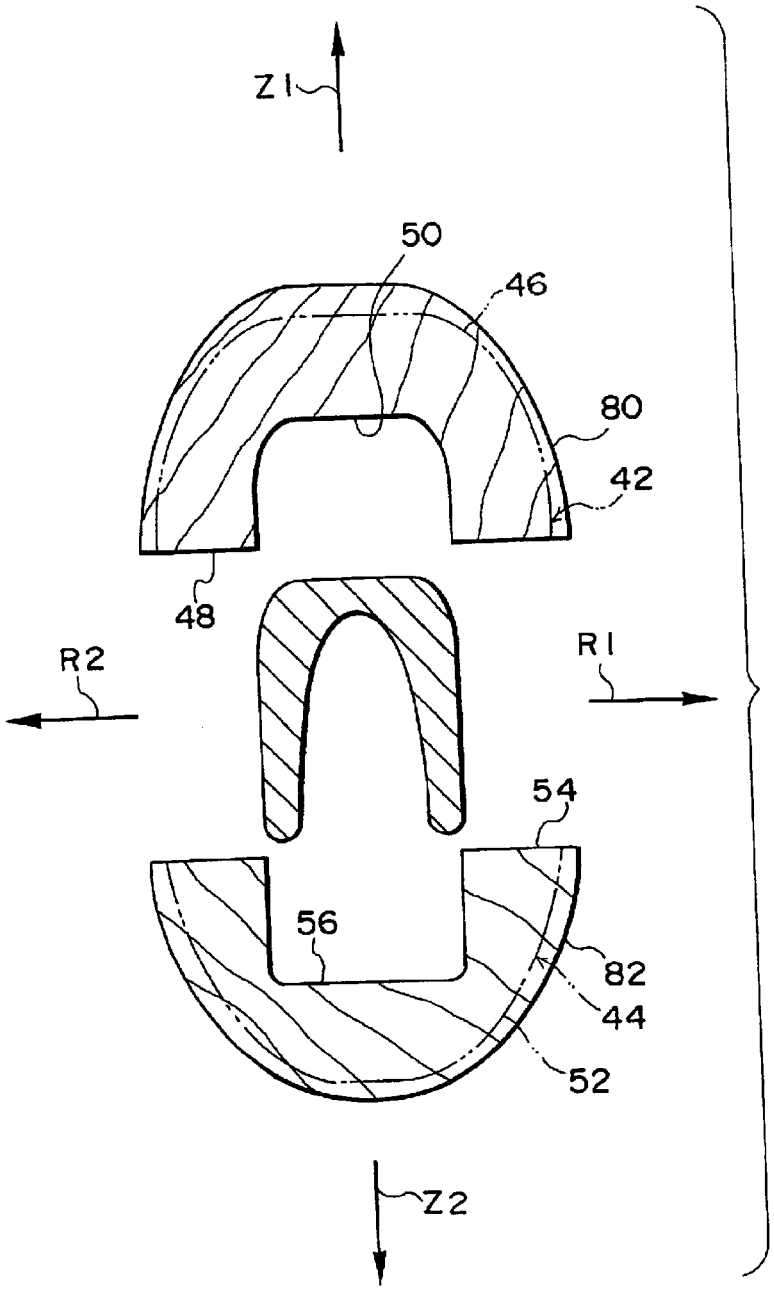
FIG. 6 is a sectional view showing a state before the wood member is shaped.

In a method for manufacturing the steering wheel having the above-described structure, first, as shown in FIG. 6, in a raw material shaping step, a raw material 80, from which the front-side piece 42 is formed, is shaped, and a raw material 82, from which the back-side piece 44 is formed, is shaped. The raw materials 80 and 82 are provided with the rim-accommodating grooves 50 and 56, however, external shapes thereof are larger than those of the front-side piece 42 and the back-side piece 44. Outer surfaces of the raw materials 80 and 82 are later carved and painted, and the like, to form the front-side piece 42 and the back-side piece 44.

Next, in a raw material attaching step, which is a wood member attaching step, the raw materials 80 and 82 are attached at predetermined positions of the rim portion 14 (i.e., positions for mounting the wood members 40).

Further, in a molding step, which is a core material molding step, the core metal 12, which has been processed in the raw material attaching step, is put in a metal mold (a mold die) for injection molding for molding the cores 26, and in this state, injection molding of, for example, urethane resin is carried out. Thus, the cores 26 are formed at sites, at which the cores 26 are to be formed, of the rim portion 14. In this state, the gaps 60 are formed between the cores 26 and the raw materials 80 and 82.

Subsequently, in a shaping step, outer surfaces of the raw materials 80 and 82 are carved and painted, and the like, to form the front-side piece 42 and the back-side piece 44 of the wood member 40. As described above, since the gaps 60 are formed between the formed cores 26 and the raw materials 80 and 82, shaping of the attached raw materials 80 and 82, and the like, can be easily carried out. Note that, although the raw materials 80 and 82 are painted after they have been shaped in the shaping step in the present embodiment, painting may be carried out in a separate step, or may not be carried out if it is not necessary.

Further, in the gaps 60 in the core metal 12, which has been processed in the shaping step, the front-side pieces 64 and the back-side pieces 66 forming the resin pieces 62 are attached. Thus, displacement of the wood members 40 relative to the cores 26 along the peripheral direction of the rim portion 14 is limited.

Next, in a covering portion attaching step, the covering portions 28 are attached so as to cover both the cores 26 and the resin pieces 62. As described above, by attaching the covering portions 28, the cores 26 and the resin pieces 62 as well as boundaries between them cannot be seen from outside. Therefore, appearance (of the steering wheel) is improved.

The present steering wheel 10 is formed through the above-described steps. In this manufacturing method, even if the surfaces of the raw materials 80 and 82 are scratched when the core metal 12 is put in the metal mold, since the shaping step is carried out after the molding step as described above, carving the outer surfaces of the raw materials 80 and 82 in the shaping step eliminates the scratches. Therefore, quality of appearance can be easily improved and maintained. In addition, since there is no need for caring about scratches made on the raw materials 80 and 82 when the core metal is put in the metal mold, working efficiency is improved, and this contributes to reduce the production cost.

Figure 7:
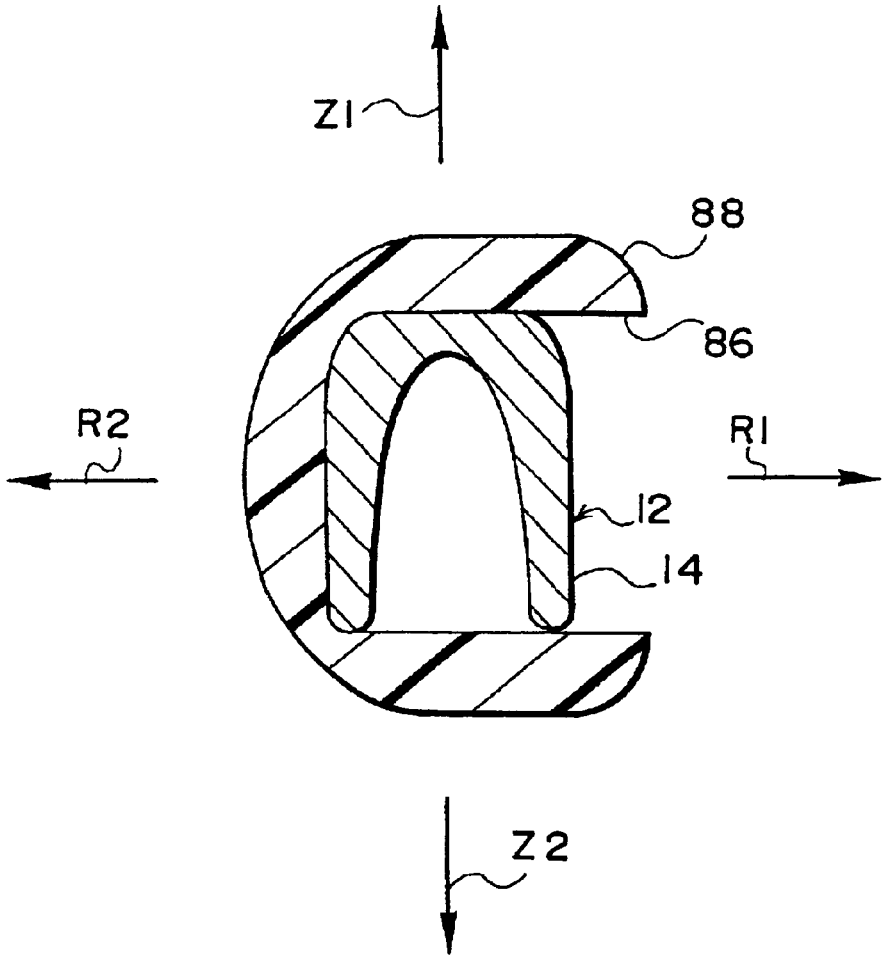
FIG. 7 is a sectional view showing a modification of the limiting member.

Note that, although the resin piece 62 includes two parts, namely, the front-side piece 64 and the back-side piece 66 in the present embodiment, the resin piece 62 may be formed of one part as in a case of a resin piece 88, shown in FIG. 7, which is provided with an opening 86 such that the rim portion 14 can be fit into the opening 86.

As described above, in the present invention, a steering wheel can be produced without scratches, or the like, made on a wooden outer covering thereof, and working efficiency can be improved.

What is claimed is:

1. A method for manufacturing a steering wheel comprising steps of:

attaching a wood member formed from a pure wooden material at a portion of a core metal which is formed in a ring shape;

forming an outer covering core material from a synthetic resin material around a predetermined site of the core metal other than a portion at which the wood member is attached;

shaping the wood member attached to the core metal after the outer covering core material is formed is formed at the predetermined site.

2. A method for manufacturing a steering wheel according to claim 1 further comprising a step of attaching a limiting member to the core metal at a portion between the wood material and the outer covering core material for limiting relative displacement of the wood member with respect to the outer covering core material along a circumferential direction of the core metal.

3. A method for manufacturing a steering wheel according to claim 2, further comprising a step of attaching a covering member over the outer covering core material and the limiting member.

* * * * *